US005191872A

United States Patent [19]

Takaishi

[11] Patent Number: 5,191,872

[45] Date of Patent: Mar. 9, 1993

[54] IGNITION COIL UNIT FOR AN INTERNAL COMBUSTION ENGINE

[75] Inventor: Tadao Takaishi, Himeji, Japan

[73] Assignee: Mitsubishi Denki Kabushiki Kaisha, Tokyo, Japan

[21] Appl. No.: 875,639

[22] Filed: Apr. 28, 1992

[30] Foreign Application Priority Data

Apr. 30, 1991 [JP] Japan ..... 3-029826[U]
Apr. 30, 1991 [JP] Japan ..... 3-029827[U]

[51] Int. Cl.[5] ..... F02P 3/04; H01F 31/00
[52] U.S. Cl. ..... 123/647; 123/634
[58] Field of Search ..... 123/634, 647

[56] References Cited

U.S. PATENT DOCUMENTS 4,198,943 4/1980 Worz ..... 123/647 X
4,951,641 8/1990 Takaishi et al. ..... 123/647
5,003,959 4/1991 Umezaki et al. ..... 123/647

FOREIGN PATENT DOCUMENTS 58-29612 6/1983 Japan .
58-30133 7/1983 Japan .

*Primary Examiner*—Tony M. Argenbright
*Attorney, Agent, or Firm*—Sughrue, Mion, Zinn, Macpeak and Seas

[57] ABSTRACT

An ignition coil unit for an internal combustion engine comprising a coil case containing an ignition coil and an ignitor case containing an ignitor for controlling a coil primary current. A heat sink is connected between the coil case and the ignitor case for dissipating heat generated in the ignitor and supporting the ignitor case on the coil case. An additional support member is provided between the ignitor case and the coil case for detachably attaching the ignitor case to the coil case. The additional support means may comprise a bridge member connected between an electrical connector for the ignitor and the ignitor case for connecting them into a unitary structure, and the bridge member may be disposed within the coil case and held within the coil case by a resin filler material.

7 Claims, 5 Drawing Sheets

IGNITION COIL UNIT FOR AN INTERNAL COMBUSTION ENGINE

BACKGROUND OF THE INVENTION

This invention relates to an ignition coil unit for an internal combustion engine.

FIG. 5 is a circuit diagram illustrating an ignition coil unit for an internal combustion engine which comprises an ignition coil 1 and an ignitor 2. As illustrated in FIGS. 6 and 7, the conventional ignition coil unit comprises the ignition coil 1 which is enclosed within a case 3 and attached to one side of a heat sink 5 in the form of a metal plate having a substantially L-shaped cross section by means of screws 6. The ignitor 2 is also enclosed within a case 4 and attached to the other side of the heat sink 5 by means of screws 7. The ignition coil 1 and the ignitor 2 are independent separate members, so that the ignition coil unit is large in overall dimension and needs a large installation space and, since the ignition coil unit must be assembled by screws, manufacturing cost is high and manufacturing efficiency is not satisfactory.

FIGS. 8 and 9 illustrate a front view and a side view, respectively, of another example of a conventional ignition coil unit in which the ignition coil 1 is enclosed within the coil case 3 and has a magnetic iron core 8, a high-tension tower 9 for providing a high-tension output therefrom and a connector 10 for establishing an electrical connection for activating the ignitor 2. The ignitor 2 is enclosed within the case 4 and is attached to a heat sink 11 which is attached to the iron core 8 by means of screws 12. As best illustrated in FIG. 8, the ignitor 2 is supported by the heat sink 11 which is a canti-levered member supported at only one end. Accordingly, the ignitor 2 supported by the canti-levered heat sink 11 is easily vibrated when subjected to the vibration of an engine or a vehicle, so that the ignition coil unit is not entirely satisfactory in terms of its vibration durability.

SUMMARY OF THE INVENTION

Accordingly, the chief object of the present invention is to provide an ignition coil unit which is free from the above-discussed problems of the conventional design.

Another object of the present invention is to provide an ignition coil unit which is compact in size and easy to manufacture.

Another object of the present invention is to provide an ignition coil unit which is high in manufacturing efficiency and low in manufacturing cost.

A further object of the present invention is to provide an ignition coil unit which has a satisfactory durability to vibration.

With the above objects in view, the ignition coil unit of the present invention comprises a magnetic iron core, an ignition coil wound around the iron core, a coil case containing the iron core and the ignition coil therein, an ignitor for controlling a primary current flowing through the ignition coil and an ignitor case containing the ignitor. A heat sink is connected between the coil case and the ignitor case for dissipating heat generated in the ignitor and supporting the ignitor case with respect to the coil case and a resin filler material is filled in the coil case for holding the ignition coil within the coil case. An additional support member is mounted between the ignitor case and the coil case. for detachably attaching the ignitor case to the coil case.

The ignition coil unit may comprise an electrical connector for connecting the ignitor to an external circuit, and the additional support member may comprise a bridge member connected between the ignitor case and the connector for connecting them into a unitary structure, and the bridge member is held within the coil case by the resin filler material. The additional support means may comprise engaging projections extending outwardly from the coil case and the ignitor case and engaging each other at the outside of the cases to support the ignitor case to the coil case.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENT

Figure 1:
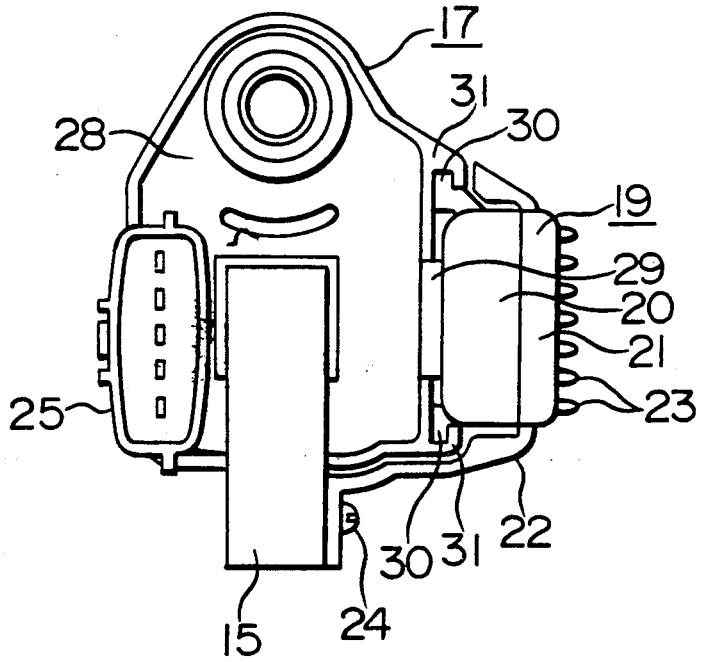
FIG. 1 is a front view illustrating the ignition coil unit for an internal combustion engine of the present invention.
Figure 2:
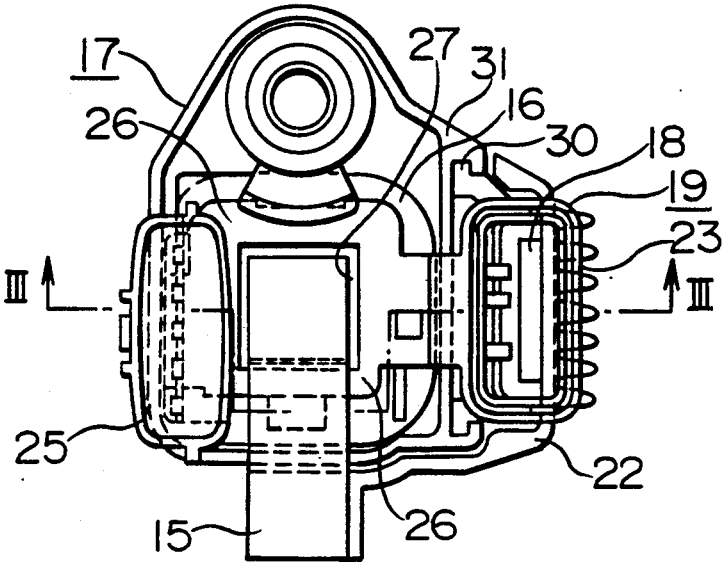
FIG. 2 is a front view similar to FIG. 1 with the resin filler material within the coil case removed.

FIGS. 1 to 4 illustrate one embodiment of an ignition coil unit for an internal combustion engine of the present invention, which comprises a magnetic iron core 15, an ignition coil 16 including a primary and secondary coils (see FIGS. 2 and 3) wound around the iron core 15, a coil case 17 containing the iron core 15 and the ignition coil 16 therein.

The ignition coil unit also comprises an ignitor 18 for controlling a primary current flowing through the ignition coil 16 and an ignitor case 19 containing the ignitor 18 therein. The ignitor case 19 is a substantially box-shaped member composed of an open-ended case body 20 and a cover 21 which is an integral part of a heat sink 22 which functions to dissipate the heat generated in the ignitor during the operation. The ignitor 18 including a power transistor (not shown) is attached to the inside surface of the heat sink 22, and a plurality of cooling fins 23 are provided on the outside surface of the heat sink 22. One end of the heat sink 22 extends along the coil case 17 and securely attached to the iron core 15 by means of screws 24. Thus, the heat sink 22 is connected between the coil case 17 and the ignitor case 19, so that the heat generated in the ignitor 18 is dissipated through the heat sink 22 and that the ignitor case 19 is supported with respect to the coil case 17.

Figure 3:
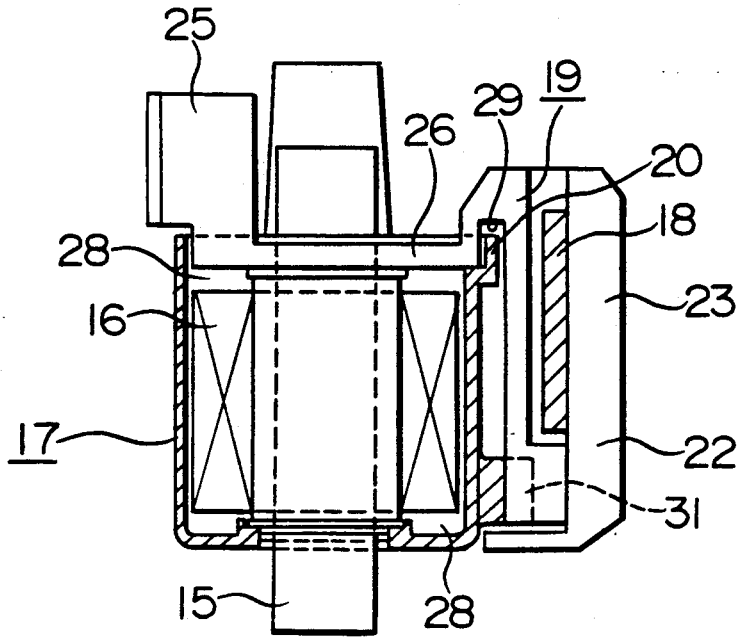
FIG. 3 is a sectional view taken along line III—III of FIG. 2.

The ignition coil unit further comprises an electrical connector 25 for connecting the ignitor 18 in the ignitor case 19 to an external electrical circuit (not shown). The connector 25 has an end that is integrally connected to a bridge member 26 connected between the ignitor case 19 and the connector 25 for connecting them into a unitary structure as best seen from FIG. 3. The bridge member 26 is a plate having a central opening 27 for allowing the iron core 15 extending therethrough, and the ignitor case 19 and the connector 25 are connected to the plate at diametrically opposite ends about the opening 27. The bridge member 26 is disposed within the coil case 17 and held in the position by a resin filler material 28 filled in the coil case 17 which also hold the ignition coil 16 and the iron core 15. As best seen in FIG. 3, the bridge member 26 engages at its edges with the open end of the coil case 17, and the engaging edge of the bridge member 26 to which the ignitor case 19 is integrally connected has a substantially U-shaped engaging groove 29 which fits over the open end edge of the coil case 17. This bridge member 26 with the engaging groove 29 therefore provides an additional support for detachably attaching the ignitor case 19 to the coil case 17 in addition to the support provided by the heat sink 22 connected between the ignitor case 19 and the iron core 15.

Figure 4:
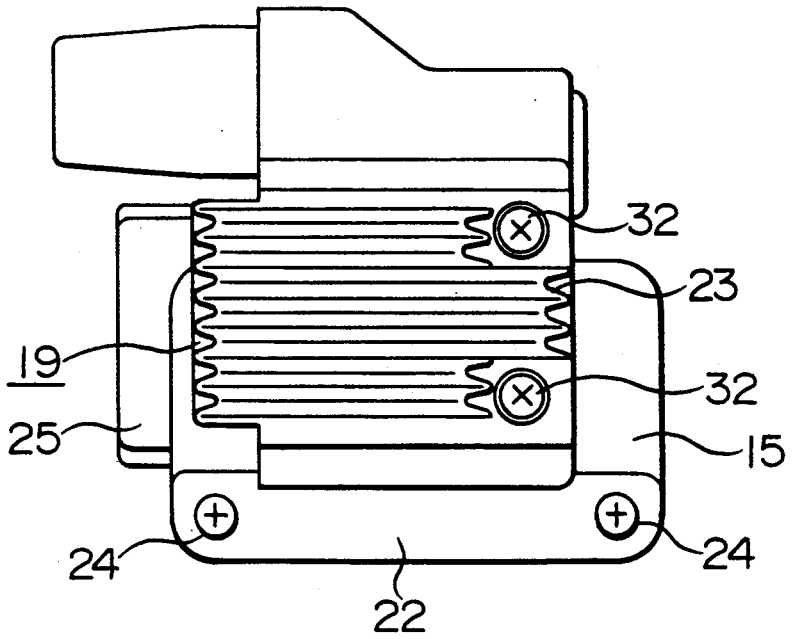
FIG. 4 is a side view of the ignition coil unit illustrated in FIG. 1.
Figure 5:
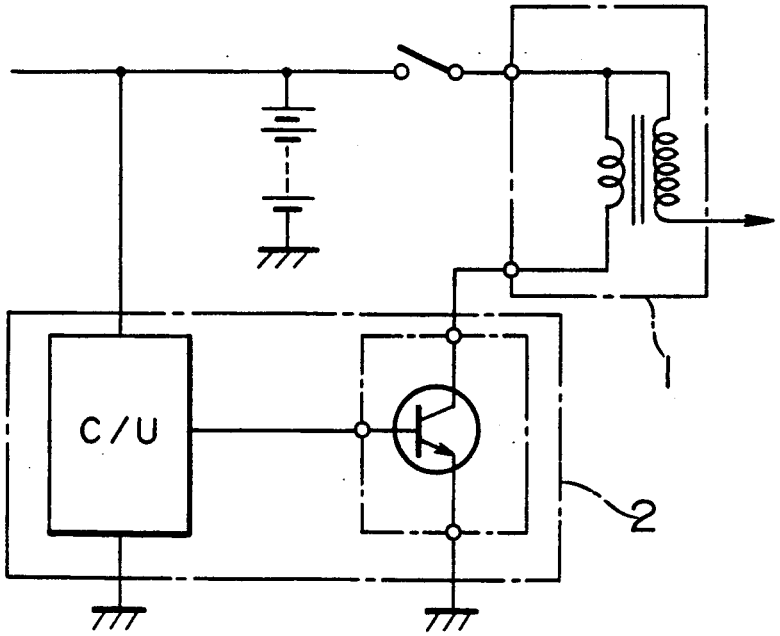
FIG. 5 is a common circuit diagram of the ignition coil unit for an internal combustion engine.
Figure 6:
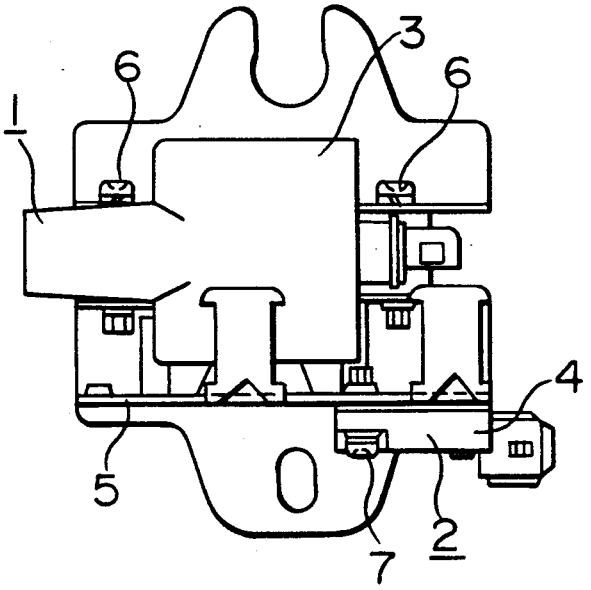
FIG. 6 PRIOR ART
FIG. 6 is a front view of a conventional ignition coil unit.
Figure 7:
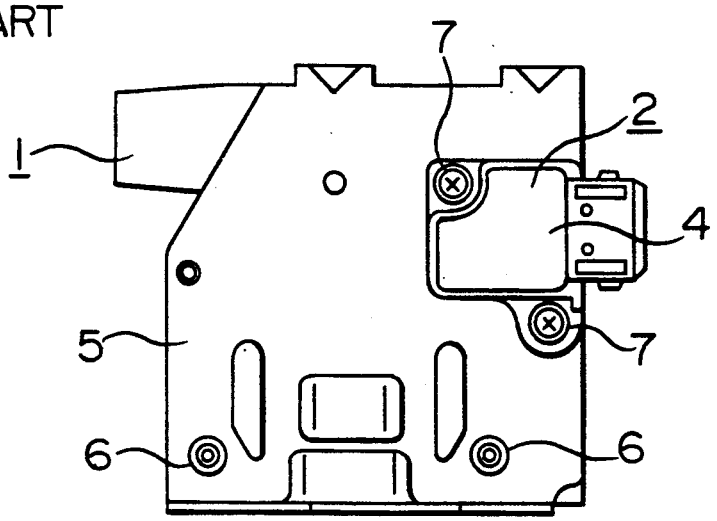
FIG. 7 PRIOR ART
FIG. 7 is a side view of the ignition coil unit illustrated in FIG. 6.
Figure 8:
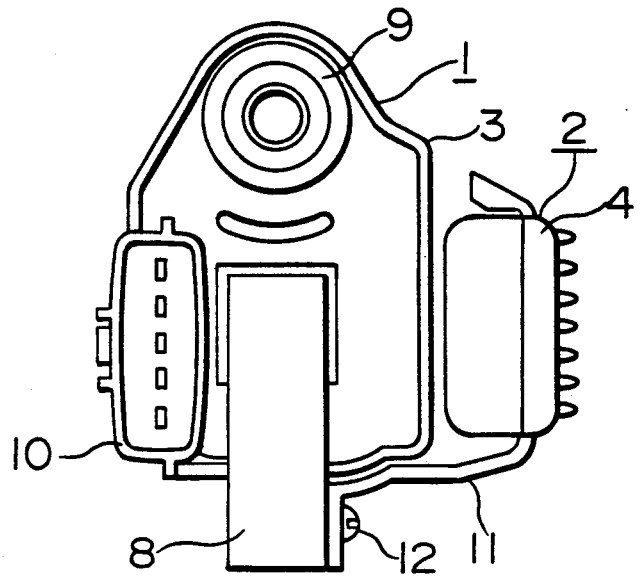
FIG. 8 PRIOR ART
FIG. 8 is a front view of another conventional ignition coil unit.
Figure 9:
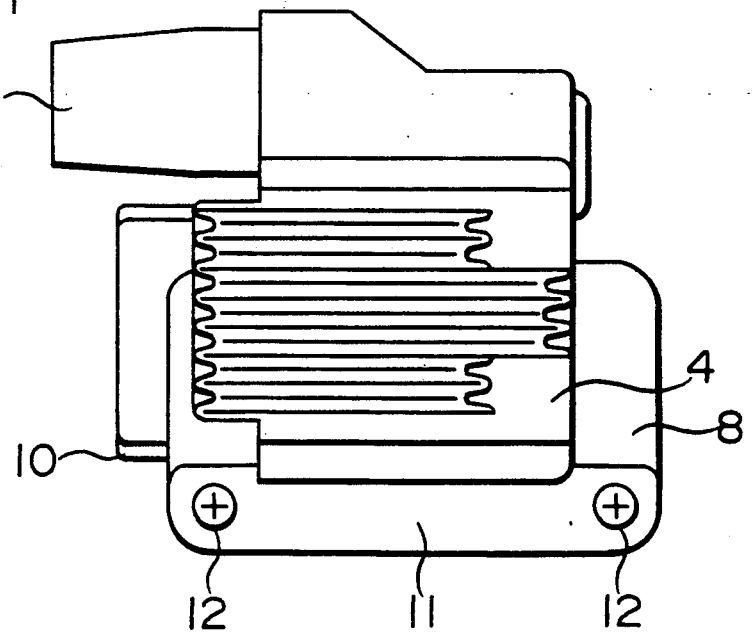
FIG. 9 PRIOR ART
FIG. 9 is a side view of the ignition coil unit illustrated in FIG. 8.

Additional support is also provided by rib-shaped engaging projections 30 integrally extending outwardly from the ignitor case 19 and engaging the hook-shaped engaging projections 31 integrally extending outwardly from the coil case 17 to support the ignitor case 19 on the coil case 17. As best seen in FIG. 4, a plurality of fastening screws 32 extending through the ignitor case 19 and threaded into the coil case 17 may be used to provide additional mechanical support.

As has been described, according to the present invention, the ignition coil unit is compact in size and easy to manufacture and is high in manufacturing efficiency and low in manufacturing cost. Also, the ignition coil unit has a satisfactory durability to vibration.

What is claimed is:

1. An ignition coil unit for an internal combustion engine, comprising:

a magnetic iron core;

an ignition coil wound around said iron core;

a coil case containing said iron core and said ignition coil therein;

an ignitor for controlling a primary current flowing through said ignition coil;

an ignitor case containing said ignitor;

a heat sink connected between said coil case and said ignitor case for dissipating heat generated in said ignitor and supporting said ignitor case with respect to said coil case;

additional support means mounted between said ignitor case and said coil case for detachably attaching said ignitor case to said coil case; and a resin filler material filled in said coil case for holding said ignition coil within said coil case.

2. An ignition coil unit as claimed in claim 1, further comprising an electrical connector for connecting said ignitor to an external circuit, and said additional support means comprises a bridge member connected between said ignitor case and said connector for connecting them into a unitary structure, said bridge member being disposed within said coil case and held within said coil case by said resin filler material.

3. An ignition coil unit as claimed in claim 2, wherein said bridge member comprises a plate having a central opening for allowing said iron core extending therethrough, and said ignitor case and said connector are connected to said plate at diametrically opposite ends about said opening.

4. An ignition coil unit as claimed in claim 1, wherein said heat sink constitutes a part of said ignitor case, and said ignitor is attached to said heat sink.

5. An ignition coil unit as claimed in claim 1, wherein said additional support means comprises engaging projections extending outwardly from said coil case and said ignitor case and engaging each other to support said ignitor case to said coil case.

6. An ignition coil unit as claimed in claim 4, wherein said additional support means comprises engaging projections extending outwardly from said coil case and said ignitor case and engaging each other to support said ignitor case to said coil case.

7. An ignition coil unit as claimed in claim 5, wherein said additional support means further comprises a fastening screw extending through said ignitor case into said coil case.

* * * * *